US009493292B2

(12) United States Patent
Kwasny

(10) Patent No.: US 9,493,292 B2
(45) Date of Patent: Nov. 15, 2016

(54) VARIABLE SPRAY HEAD

(75) Inventor: Hans-Peter Kwasny, Heilbronn (DE)
(73) Assignee: Peter Kwasny GmbH, Gundelsheim (DE)

( * ) Notice: Subject to any disclaimer, the term of this patent is extended or adjusted under 35 U.S.C. 154(b) by 274 days.

(21) Appl. No.: 13/982,352

(22) PCT Filed: Jan. 25, 2012

(86) PCT No.: PCT/EP2012/000326
§ 371 (c)(1),
(2), (4) Date: Oct. 28, 2013

(87) PCT Pub. No.: WO2012/100941
PCT Pub. Date: Aug. 2, 2012

(65) Prior Publication Data
US 2014/0048623 A1 Feb. 20, 2014

(30) Foreign Application Priority Data
Jan. 28, 2011 (DE) ..... 10 2011 009 627

(51) Int. Cl.

| | |
|---|---|
| ***B05B 7/32*** | (2006.01) |
| ***B65D 83/28*** | (2006.01) |
| ***B05B 1/30*** | (2006.01) |
| ***B65D 83/20*** | (2006.01) |
| ***B65D 83/44*** | (2006.01) |

(52) U.S. Cl.
CPC ..... *B65D 83/28* (2013.01); *B05B 1/3026* (2013.01); *B65D 83/205* (2013.01); *B65D 83/207* (2013.01); *B65D 83/44* (2013.01)

(58) Field of Classification Search
CPC B05B 1/3026; B65D 83/205; B65D 83/207; B65D 83/16; B65D 83/14; B65D 83/28; B65D 83/44
USPC ..... 239/337, 569, 579, 302, 338, 339; 251/208
See application file for complete search history.

(56) References Cited

U.S. PATENT DOCUMENTS

| | | | | | |
|---|---|---|---|---|---|
| 3,407,977 | A | * | 10/1968 | Gianantonio Ruggeri | 222/554 |
| 3,949,966 | A | * | 4/1976 | Fabish | 251/206 |
| 4,162,882 | A | * | 7/1979 | Rose | 425/382 R |
| 4,366,947 | A | * | 1/1983 | Voege | 251/206 |
| 4,700,928 | A | * | 10/1987 | Marty | 251/310 |

* cited by examiner

*Primary Examiner* — Justin Jonaitis
(74) *Attorney, Agent, or Firm* — Berliner & Associates

(57) ABSTRACT

The invention relates to a spray head (1) for a spray can with the spray head to be placed on a valve having an inner valve seat, wherein said spray head (1) being provided with a tubular hollow cylinder (2) extending coaxially to the longitudinal axis of the spray can, said cylinder being coupleable to the valve and designed to include a passage (3) for the spraying product contained in the spray can, said passage (3) ending in an outlet nozzle (4) pointing in radial direction and said hollow cylinder (2) having an opening (5) on one of its longitudinal sides at its valve-side end so that actuating the spray head (1) allows the product to be sprayed to enter the hollow cylinder (2) through said opening (5), and wherein a rotatable regulating pin (6) extends through the passage (3) in the hollow cylinder (2), the outer diameter of said regulating pin (6) corresponding at its valve-side end to the inside diameter of the passage (3) arranged in the hollow cylinder (2) and said regulating pin (6) having at its valve-side end on one of its longitudinal sides a cutout (7) that, when said cutout (7) coincides with the opening (5) in the hollow cylinder (2), enables sprayed product to enter the passage (3), with the regulating pin (6) at its end facing away from the valve being connected to a rotatable regulator (8) accessible from the outside. In this manner a spray head (1) is provided that enables the discharge rate to be varied and effectively avoids an uncontrolled discharge of sprayed product from spray head (1). The invention is of special significance in the field of paint spray cans.

7 Claims, 5 Drawing Sheets

VARIABLE SPRAY HEAD

The invention relates to a spray head for a spray can with the spray head to be placed on a valve having an inner valve seat, wherein said spray head being provided with a tubular hollow cylinder extending coaxially to the longitudinal axis of the spray can, said cylinder being coupleable to the valve and designed to include a passage for the spraying product contained in the spray can, said passage ending in an outlet nozzle pointing in radial direction and said hollow cylinder having an opening on one of its longitudinal sides at its valve-side end so that actuating the spray head allows the product to be sprayed to enter the hollow cylinder through said opening.

Spray cans are widely used for a multitude of applications. Among other uses, is spray cans are also employed for paint spraying purposes and are a cost-effective and in comparison easily applied alternative to paint spraying equipment. Nowadays, paint spray cans are more and more frequently used for professional purposes as well. In the do-it-yourself sector paint spray cans have been commonly known and applied for a long time. Besides, paint spray cans are also used to some extent by artist.

More often than not it will certainly be desirable for the user to decrease or increase the paint discharge rate or spray pattern in a simple manner. For example, a high paint discharge rate may as a rule be useful if large surfaces are to be uniformly coated but for the painting of smaller surfaces or when more intricate painting jobs are to be carried out it may be desirable to keep the discharge rate as low as possible so as to gain better control over the painting operation in this way.

Prior-art spray heads with regulating function have been known and disclosed for example by publications WO 2005/051802 A1 or U.S. Pat. No. 3,407,977. With the spray cans described in these publications the sprayed material initially enters the spray head before a passage is created for the sprayed material within the spray head by adjusting the relevant cross sectional area to enable the discharge rate to be appropriately varied. Various problems may be encountered with this configuration. For instance, sprayed product may accumulate in the spray head when the valve is closed. This results in an undefined quantity of sprayed product remaining in the spray head ahead of the regulating mechanism when the valve has been closed and escaping in an uncontrolled manner from the spray head when the valve is again actuated so that "spitting" or "sputtering" may occur and product being discharged in an unregulated way.

Another drawback is encountered in that an increased amount of sprayed material collects within the spray head when the regulating mechanism in the spray head is fully closed. If the regulating mechanism is again activated in such a case this will also cause spray head "sputtering" characteristics. In the event a propellant gas at high partial pressure is used even the spray head may become detached from the valve.

Remnants of the sprayed product in the spray head even cause an additional issue as said product residue gums up the regulating mechanism. Especially when the spray can is used with paint material this problem may in fact arise because the paint hardens and causes the movable parts of the spray head to become clogged up which makes it very difficult to actuate the spray head or regulating mechanism.

Proceeding from what is known from prior art as described hereinbefore it is therefore the objective of the present invention to provide a spray head that not only solves the described problems but in addition enables the discharge rate to be regulated without difficulty.

In accordance with the invention this objective is reached by a spray head for a spray can with the spray head to be placed on a valve having an inner valve seat, wherein said spray head being provided with a tubular hollow cylinder extending coaxially to the longitudinal axis of the spray can, said cylinder being coupleable to the valve and designed to include a passage for the spraying product contained in the spray can, said passage ending in an outlet nozzle pointing in radial direction and said hollow cylinder having an opening on one of its longitudinal sides at its valve-side end so that actuating the spray head allows the product to be sprayed to enter the hollow cylinder through said opening, and to wherein a rotatable regulating pin extends through the passage in the hollow cylinder, the outer diameter of said regulating pin corresponding at its valve-side end to the inside diameter of the passage arranged in the hollow cylinder and said regulating pin having at its valve-side end on one of its longitudinal sides a cutout that, when said cutout coincides with the opening in the hollow cylinder, enables sprayed product to enter the passage, with the regulating pin at its end facing away from the valve being connected to a rotatable regulator accessible from the outside.

Other than a spray head described for example in publication U.S. Pat. No. 3,407,977 the inventive spray head is designed so as to be capable of being combined with a valve having an inside valve seat. Such valves are also known as female valves. Female valves do not possess an upright valve stem but instead an inside valve seat with the spray head being plugged onto the valve. The spray head is provided with a stem or hollow cylinder arranged in the center and extending coaxially with the longitudinal axis of the can, said stem or cylinder being hollow inside and allowing sprayed material to pass through. The sprayed material then progresses through the axially extending stem and into a lateral spraying duct extending in radial direction, said spraying duct ending in an outlet nozzle. Through the outlet nozzle the sprayed material as well as the propellant, if applicable, are discharged into the surrounding area The radially arranged spraying duct and the cylinder which is hollow inside and extends in axial direction jointly form a passage for the sprayed material passing through the spray head.

In the event a spray head for female valves is used the product to be sprayed is introduced into the hollow cylinder via a dosing slot also known as metering groove. Said dosing slot is a slot-like opening provided at the valve-side end of the hollow cylinder. As a rule, the dosing slot thus forms an axially extending small slot arranged in the wall of the hollow cylinder. When the spray head is actuated by exerting pressure on the usually flattened top surface of the spray head the dosing slot is pushed downward through an opening in the inner seal of the valve so that the material to be sprayed is introduced into the hollow cylinder. Upon release of the spray head a spring arranged in the valve pushes the valve seat and thus the hollow cylinder upwards again resulting in the dosing slot to be repositioned at a location above the inner seal. An ingress of sprayed material is ruled out in this position.

In accordance with the invention the amount of sprayed product entering the hollow cylinder through the cutout which in most cases is a dosing slot extending in axial direction and being arranged in the wall of the hollow cylinder is now regulated. For this purpose an additional regulating pin extends through the interior of the hollow cylinder with said regulating pin being provided with an opening at its valve-side end on one of its longitudinal sides. Said longitudinal side extends parallelly to the longitudinal axis of the spray can. The outer diameter of the regulating pin at its valve-side end, i.e. the lower end when the spray can is in upright position, coincides with the inside diameter of the hollow cylinder. This configuration thus results in a partial form closure between the inner wall of the hollow cylinder and the outer wall of the regulating pin, wherein said form closure must at least exist in the valve-side area of the regulating pin but may also extend over the entire length of the hollow cylinder. However, as another design possibility the regulating pin at its valve-side end only may have an outer diameter that coincides with the inner diameter of the hollow cylinder whereas in the direction of the regulator there is an area where the diameter reduces, for example in that a relatively thin pin is provided. All that is important here is that in the valve-side area of hollow cylinder and regulating pin there must be a form closure allowing the discharge rate to be regulated as a result of the overlap of the opening in the hollow cylinder and the cutout in the regulating pin varying to a greater or lesser extent. The passage of sprayed product through the hollow cylinder is thus achieved if the position of the opening in the hollow cylinder and the cutout in the regulating pin coincide at least partially if opening and cutout coincide fully the discharge rate is maximal; in the event the opening and cutout positions do not at all coincide no sprayed material or only a minor amount will exit. The regulating pin can be rotated around the longitudinal axis of the spray can respectively spray head. For this purpose, the end of the regulating pin opposite to its valve-side end extends outwardly, i.e. to the upper side of the spray head where it is accessible from the outside. The cutout provided in the regulating pin may be of different shape, all that is to be warranted in this case is that when in discharge position, when the opening in the hollow cylinder and the cut-out in the regulating pin are congruent, there is an axially extending passage for the sprayed product that reaches up to the portion of the passage that leads in radial direction towards the outlet nozzle.

The axial passage for the sprayed product may extend alongside the regulating pin or even through the regulating pin. In the former case, the cutout in the regulating pin extends from the valve-side end of the regulating pin to that portion of the passage on one longitudinal side of the regulating pin that leads in radial direction towards the outlet nozzle. Normally and with respect to its cross section the regulating pin has a circular basic form of which an arc-like segment has been cut out. In other words, on its valve-side end the cross section of the regulating pin has a circular shape with a circle segment being cut out. When the chord limiting the circle segment (the circular section) coincides with the diameter of the circle the cutout is semi-circular with respect to the cross section: however the height of the circle segment may also be lower. Turning the regulating pin and thus causing the circular-segmented cutout being positioned so as to be congruent with the opening in the hollow cylinder sprayed material is allowed, upon actuation of the spray head, to enter the space formed by the cutout in the regulating pin between the outside of the regulating pin and the inside of the hollow cylinder. Along the regulating pin the sprayed material is thus transferred up to the portion of the passage that extends in radial direction.

Nevertheless, the cutout must not always be shaped in the form of a circle segment with respect to the cross sectional area. Other alternatives are conceivable as well to create a free space between the outer wall of the regulating pin and the inner wall of the hollow cylinder to enable sprayed material to be transferred towards the outlet nozzle. For example, the valve-side end of the regulating pin may be designed in the form of a longitudinally slotted tube if the longitudinal slot and the opening in the hollow cylinder coincide a large amount of sprayed material is allowed to enter while turning the regulating pin causes the opening in the hollow cylinder and the tube of the regulating pin to overlap thus resulting in the spray head to be closed at least to a great extent. There are of course various intermediate positions resulting in a portion of the opening being covered by the regulating pin whereas another portion is freely accessible. The regulating pin in fact functions as a kind of orifice for the opening in the hollow cylinder. In accordance with the invention the term "longitudinal slot" is to be understood to have a broad meaning and shall also cover very wide slots so that the regulating pin at its valve-side end may, for example, be designed in the form of a tube cut in longitudinal direction, for instance a tube cut in half in longitudinal direction. At its valve-side end the regulating pin in this case is designed to form a groove or channel extending in longitudinal direction.

A cutout in the form of a circle segment need not necessarily extend continuously up to the portion of the passage arranged on one longitudinal side of the regulating pin and leading in radial direction towards the outlet nozzle. It is also possible to provide a cutout in the form of an arc-like segment on the valve-side end of the regulating pin followed by another cutout of different shape arranged in the direction of the regulator. This cutout may, for instance, be provided in the form of a diameter reduction of the regulating pin, i.e. the diameter of the regulating pin corresponds at the valve-side end with the inside diameter of the hollow cylinder whereas said diameter reduces in the direction of the regulator (that is further up with the spray can in upright position). Accordingly, a gap is created in the area between the hollow cylinder and the regulating pin through which sprayed material is allowed to pass. Another alternative is a cutout in the regulating pin in the form of an arc-like sector seen with reference to the cross sectional area.

The passage for the sprayed material to the passage portion arranged in radial direction towards the outlet nozzle may alternatively also extend through the interior of the regulating pin. In this case the regulating pin is provided with a lateral opening capable of being made congruent with the portion of the passage leading in radial direction towards the outlet nozzle, wherein a channel in the interior of the regulating pin extends between said opening and the cutout in the regulating pin through which sprayed product is allowed to pass. Upon actuation of the spray head the sprayed product thus passes initially through the cutout in the regulating pin into the channel arranged inside the regulating pin, then in longitudinal direction through the regulating pin, and the sprayed material exits at the opening where it is then admitted to the radial portion of the passage.

The outlet nozzle may form an integral part of the spray head; however the nozzle is frequently designed so that it can be removably inserted into the spray head. This enables the spray nozzle to be replaced as desired to achieve another spray pattern, for example by selecting a round- or flat-jet spray nozzle.

A major advantage of the invention as compared to regulating mechanisms known from prior art is that the regulating effect is brought about directly at the valve/spray head interface. In this manner, an accumulation of sprayed product in the spray head is avoided which, as mentioned earlier, may otherwise result in product "sputtering", i.e.

uncontrolled discharge of sprayed product from the is spray head. The spraying results thus achieved are particularly smooth and uniform, a necessity of major significance especially when paint spray cans are employed. By positioning the opening in the hollow cylinder so as to coincide to greater or lesser degree with the cutout in the regulating pin the amount discharged can be adjusted between 0 for a low discharge rate) and 100%.

The rotatable regulator may in particular be provided in the form of a circular disk covering the end of the spray head facing away from the valve. Said rotatable regulator is arranged on top of the spray head with the spray can in upright position. In particular, the rotatable regulator may form the top side of the spray head on which pressure is exerted to open the valve. Moreover, the discharge rate can be adjusted by turning the regulator. Since adjusting the discharge rate is achieved by turning the regulator while opening the valve requires pushing down the head it is ensured that the discharge rate cannot be varied inadvertently when the spray head is actuated. The turning characteristics of the regulator should ensure that, on the one hand, the regulator can be turned without difficulty and moreover that any undesired automatic turning is in fact ruled out. To improve the turning characteristics of the regulator serrations may be provided on the outside of the regulator. Another design option here is to provide detents/ratchets intended to secure the angular position of the regulator.

To make sure the regulator including molded-on regulating pin cannot be detached inadvertently from the spray head, means can be provided to securely attach the regulating pin respectively regulator to the spray head. This may for example be achieved by arranging for a regulator pin section to have a greater diameter. Such a thicker portion ensures the regulating pin including regulator is normally safely retained in the spray head but nonetheless is still capable of being rotated. However, by using a certain amount of force the regulating pin may also be pulled out of the spray head. Reversely, such an embodiment facilitates mounting the spray head according to the invention.

Aside from the spray head the invention also relates to a spray can provided with a can body containing the product to be sprayed as well as a propellant, a valve with inside valve seat as well as a spray head as described hereinbefore. The invention has particular significance in the field of paint material spray cans because an exact dosing of the spray jet is of utmost importance here. Nevertheless, the inventive spray head resp. spray can may of course be employed for other purposes and in other fields.

Further elucidation of the invention is provided through the enclosed figures, where FIG. 1 is a sectional view of an inventive spray head;

Figure 1:
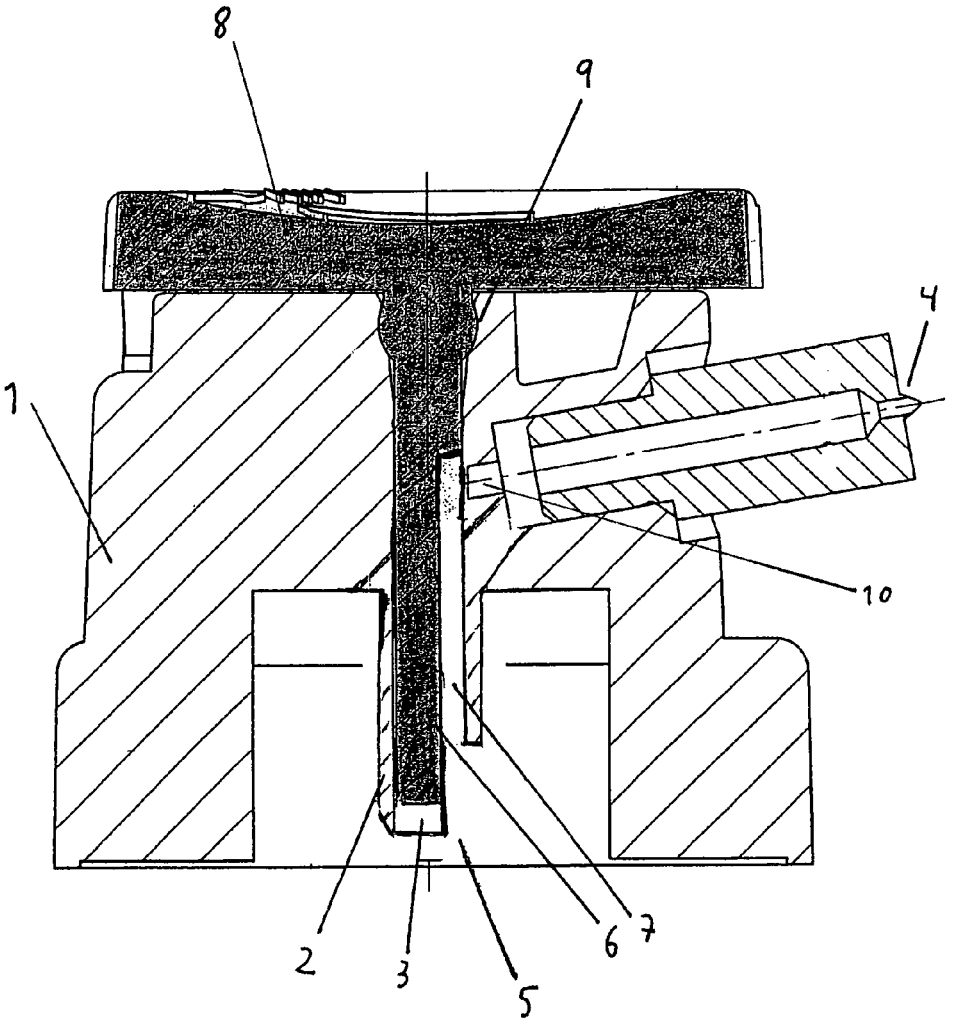

The inventive spray head 1 is illustrated in FIG. 1 as a sectional view along an axis corresponding to the longitudinal axis of the spray can. The spray head 1 is of female design for insertion into a valve provided with an inside valve seat. For this purpose the spray head 1 is provided with a hollow cylinder 2 arranged in the center and extending coaxially with the longitudinal axis of the can, with a passage 3 for the sprayed product extending through said cylinder. Sprayed material is transferred through passage 3 up to the radially extending spray channel 10 through which the material passes on towards outlet nozzle 4.

At its valve-side end the hollow cylinder 2 has a slot-like opening 5. When the valve is actuated the sprayed product or material is allowed to enter passage 3 through opening 5 whereas hollow cylinder 2 is otherwise closed over its remaining circumference. As can be seen from the illustration in FIG. 1 the slotlike opening 5 in hollow cylinder 2 is located at the bottom right-hand side. As a rule, the slot-like opening 5 is narrow, with the slot extending in longitudinal direction, i.e. coaxially to the longitudinal axis of the can.

A regulating pin 6 extends through the passage 3 of the hollow cylinder 2, the outer diameter of said pin at the valve-side end corresponds to the inner diameter of the passage 3 in hollow cylinder 2. A cutout 7 is arranged on one side of regulating pin 6. If the cutout 7 is positioned so as to be congruent with the slotlike opening 5 in hollow cylinder 2 the passage 3 is clear to allow sprayed product to pass. However, turning the regulating pin 6 causes positions of cutout 7 and opening 5 to either no longer coincide at all or to minor extent only so that the discharge of sprayed product is reduced or even discontinued altogether. In the representation shown in FIG. 1 the opening 5 and cutout 7 are congruent, i.e. the position shown permits a great volume of sprayed material to be discharged. However, rotating the regulating pin 6 by 180° for example would result in the solid portion of the regulating pin 6 illustrated dark in the representation chosen in FIG. 1 to move to the right and thus cover the opening 5 either completely or to a major extent. The discharge rate in this case would be significantly lower or even zero.

To enable regulating pin 6 to be rotated around its longitudinal axis said pin is provided at its end facing away from the valve (top position here) with regulator 8 which is a circular disk covering the end of spray head 1 located away from the valve. The discharge rate can thus be adjusted and varied by turning or rotating the regulator 8 while the actual spraying operation is started by exerting pressure from above on the regulator 8. To enable regulator 8 together with the regulating pin 6 to be captivatedly attached to the spray head 1 the regulating pin 6 is provided with a thickening 9 in the pin portion facing away from the valve side so that regulator 8 with regulating pin 6 can only be pulled out by exerting a considerable amount of force.

Figure 2:
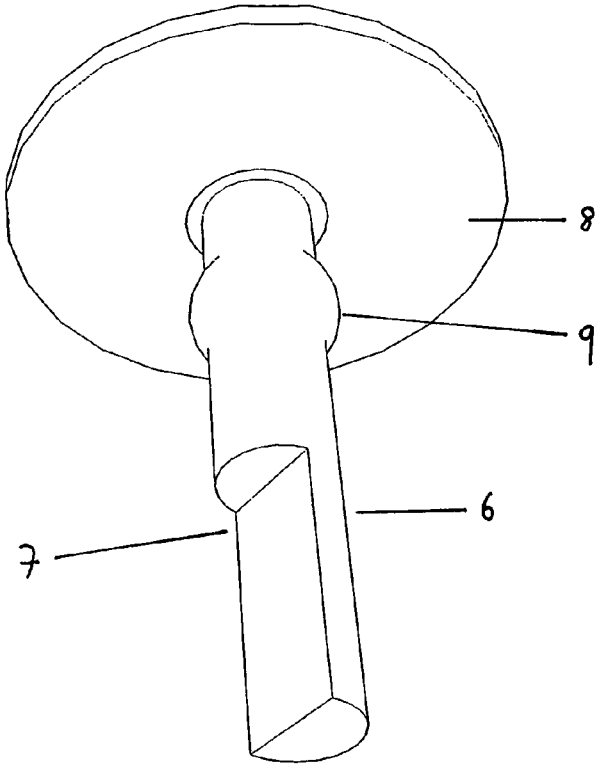
FIGS. 2-6 show different embodiments of a regulating pin.

Shown in FIG. 2 is an example of a regulating pin 6 in accordance with the s present inventory In this case the cutout 7 in the regulating pin has the shape of an arc-like segment. Accordingly, if the arc-like segment of cutout 7 is positioned so as to be congruent with the opening 5 of hollow cylinder 2 sprayed material is allowed to exit while this discharge rate is minimized in case the round side of regulating pin 6 is turned towards opening 5. From the figure it is also evident to that cutout 7 extends roughly over half the length of regulating pin 6. With this embodiment cutout 7 must at least extend in the longitudinal direction of the spray can to such a location that enables the sprayed product to enter the radially extending spray channel 10 and thus be transferred to outlet nozzle 4.

Figure 3:
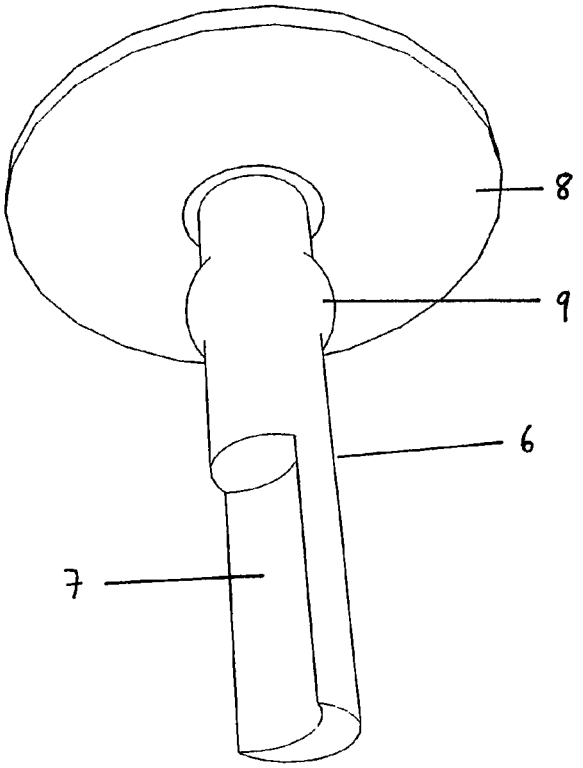

FIG. 3 shows an alternative embodiment according to which the cutout 7 has is not the shape of an arc-like segment but the valve-side end of regulating pin 6 is instead shaped in the form of a longitudinally slotted tube. Otherwise, the functioning of the regulating pin is identical to that described hereinbefore, i.e. if the position of cutout 7 is congruent with that of opening 5 in the hollow cylinder 2 sprayed product is allowed to exit and can pass through cutout 7 to the radially extending spraying channel 10.

Figure 4:
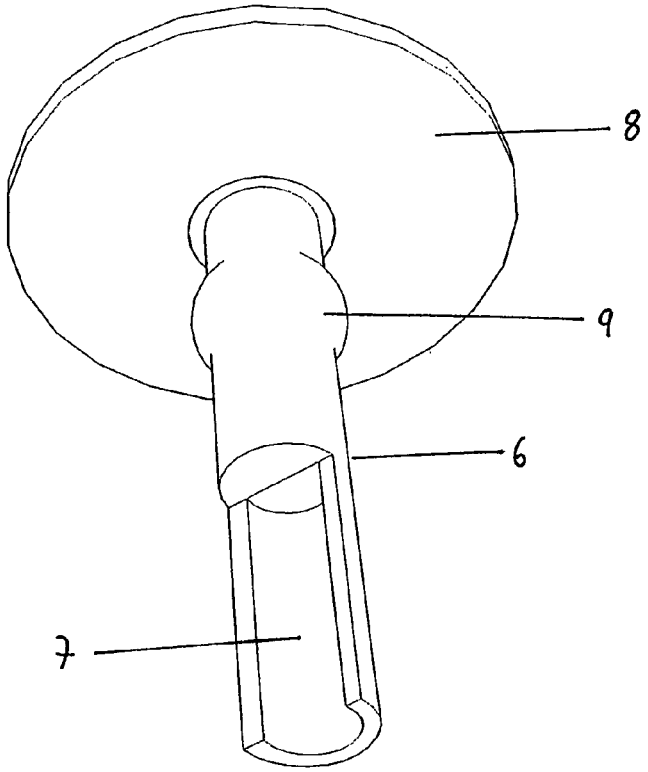

FIG. 4 depicts a similar embodiment with the exception that the size of cutout 7 is even greater, i.e. the valve-side portion of the regulating pin has been shaped to even more resemble a longitudinally slotted tube, where it is to be noted that a rather wide longitudinal slot has been provided in this case. The width of the longitudinal slot may, for example, be selected such that ultimately only half of the tube remains.

Figure 5:
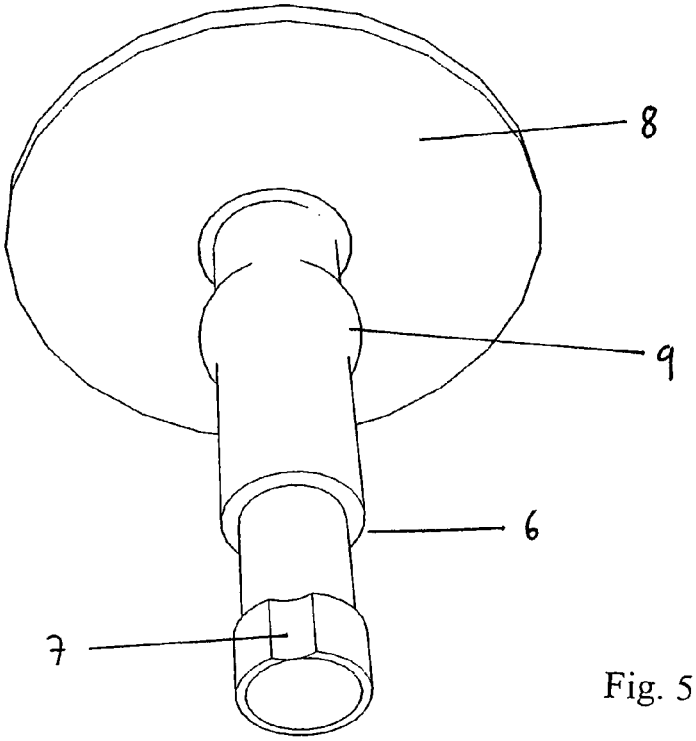

FIG. 5, illustrates another embodiment wherein the regulating pin 6 has a larger cross section at the valve-side end than in the area adjacent to it in the direction towards regulator 8. A cutout 7 is as well provided here at the valve-side end of the regulating pin 6. Through this cutout sprayed product is allowed to pass on in longitudinal direction to the area of the regulating pin 6 having a smaller diameter which ensures the product can be transferred to the radially extending spraying channel 10.

Moreover, in all of the FIGS. 2 to 6 regulator 8 has been shown, said regulator being shaped in the form of a circular disk, wherein a thickening 9, i.e. an area of the regulating pin 6 of increased cross section, is provided which although it allows the regulating pin 6 to be rotated around its longitudinal axis otherwise ensures that the pin is firmly seated in spray head 1. Nonetheless, by exerting a certain amount of force the regulating pin 6 may be pulled out of the spray head 1.

Figure 6:
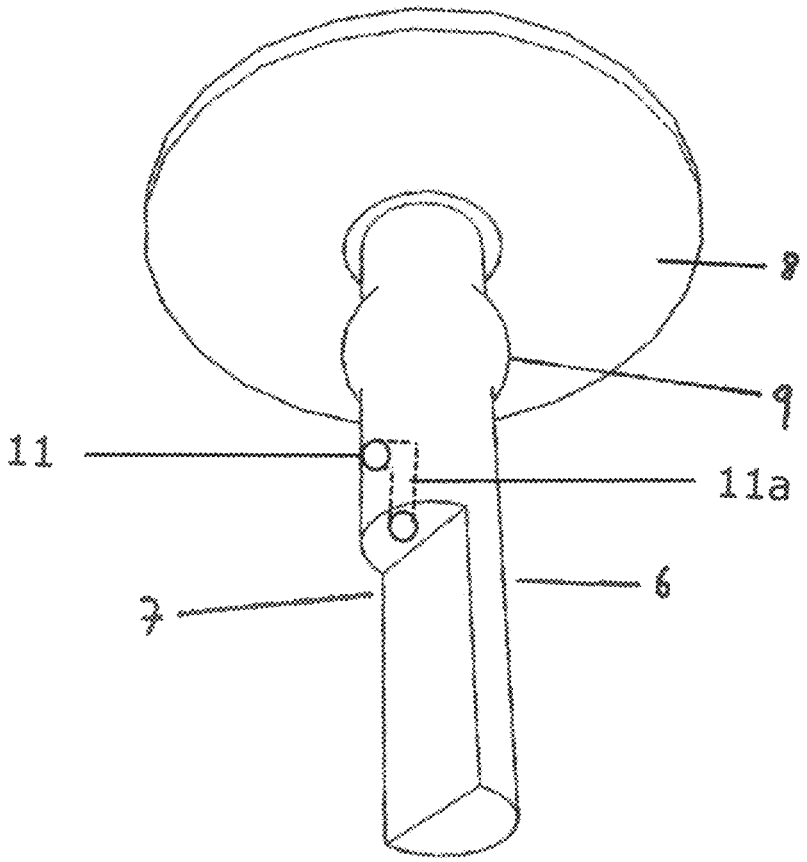

Referring to FIG. 6, the regulating pin 6 is provided with a lateral opening 11 capable of being made congruent with the portion of passage 10 leading in radial direction towards the outlet nozzle 4, wherein a channel 11*a* in the interior of the regulating pin 6 extends between said opening 11 and the cutout 7 in the regulating pin 6 through which sprayed product passes.

Figure 7:
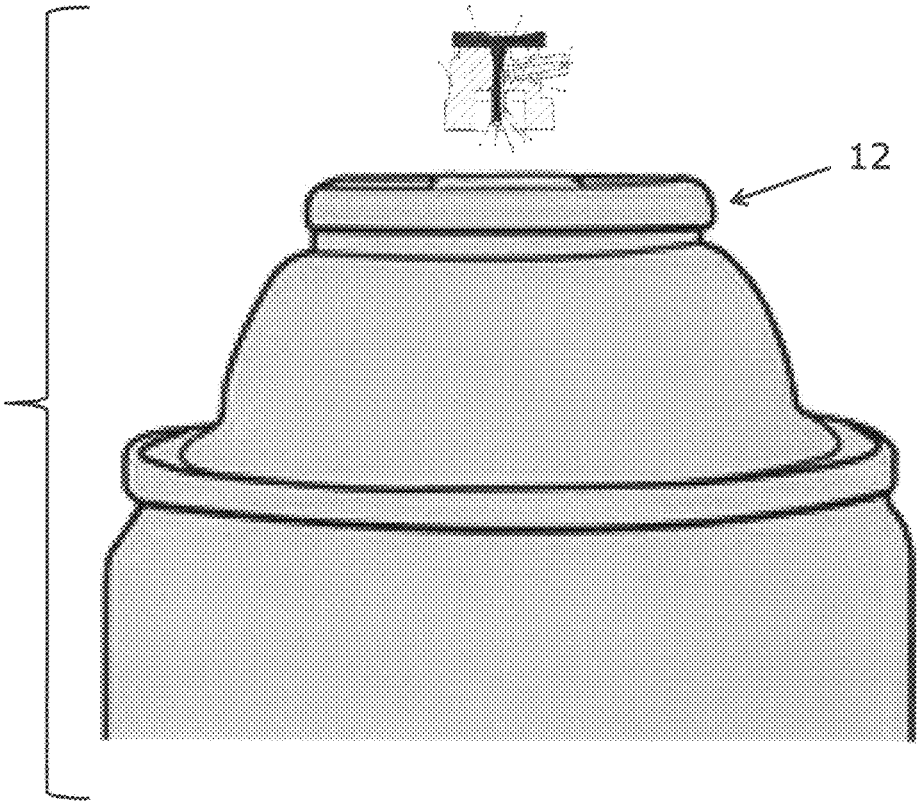
FIG 7 shows the spray head of FIG. 1 as approached to the female valve of an aerosol dispenser known to the art.

Referring to FIG. 7, the spray head of FIG. 1 is shown as approached to the female valve 12 of an aerosol dispenser known to the art.

The invention claimed is:

1. In a spray head for a spray can having a longitudinal axis, the spray head to be placed on a valve having an inside valve seat and an inner seal, wherein said spray head (1) is provided with a tubular hollow cylinder (2) having longitudinal sides and extending coaxially to the longitudinal axis of the spray can, said cylinder being coupleable to the valve at a valve-side end and designed to include a passage (3) for a spraying product contained in the spray can, said passage (3) ending in an outlet nozzle (4) pointing in radial direction and said hollow cylinder (2) having an opening (5) on one of its longitudinal sides at the hollow cylinder's valve-side end so that actuating the spray head (1) allows the product to be sprayed to enter the hollow cylinder (2) through said opening (5), the improvement according to which a rotatable regulating pin (6) extends through the passage (3) in the hollow cylinder (2), said regulating pin (6) having longitudinal sides and a valve-side end, and corresponding at the pin's valve-side end to an inside diameter of the passage (3) arranged in the hollow cylinder (2), and said regulating pin (6) having at its valve-side end on one of the regulating pin's longitudinal sides a cutout (7) that, when said cutout (7) coincides with the opening (5) in the hollow cylinder (2), enables the product to be sprayed to enter the passage (3), with the regulating pin (6) at an end opposite the regulating pin's valve-side end being connected to a rotatable regulator (8) accessible from the outside, wherein the hollow cylinder of the spray head is pushed downward and the opening in the hollow cylinder is pushed through an opening in the inner seal of the valve when the spray head is plugged onto the valve and actuated, so that the product to be sprayed is introduced into the hollow cylinder, and wherein the hollow cylinder is pushed upward resulting in the opening of the hollow cylinder to be repositioned at a location above the inner seal when the spray head is released from actuation.

2. Spray head according to claim 1, characterized in that the cutout (7) in the regulating pin (6) extends from the valve-side end of the regulating pin (6) to a spray channel (10) that leads in radial direction towards the outlet nozzle (4).

3. Spray head according to claim 1, characterized in that the regulating pin (6) is provided with a lateral opening (11) capable of being made congruent with the portion of passage (10) leading in radial direction towards the outlet nozzle (4), wherein a channel (11*a*) within the regulating pin (6) extends between said opening and the cutout (7) in the regulating pin (6) through which sprayed product passes.

4. Spray head according to claim 1, characterized in that the cutout (7) in regulating pin (6) is designed to form a circle segment viewed as a cross sectional representation.

5. Spray head according to claim 1, characterized in that the valve-side end of regulating pin (6) is a longitudinally slotted tube.

6. Spray head according to claim 1, characterized in that the rotatable regulator (8) is a circular disk covering an end of the spray head (1) facing away from the valve.

7. In a spray can provided with a can body that contains a sprayed product as well as a propellant and a valve with an inside valve seat, the improvement comprising a spray head (1) according to claim 1.

* * * * *